US007849792B2

(12) United States Patent
Bauer et al.

(10) Patent No.: US 7,849,792 B2
(45) Date of Patent: Dec. 14, 2010

(54) SYSTEM FOR PRINTING PASSING OBJECTS

(75) Inventors: Stefan Bauer, Thüngersheim (DE); Alfred Bausenwein, Thüngersheim (DE); Josef Kleinschnitz, Greussenheim (DE)

(73) Assignee: KBA-Metronic AG, Veitshochheim (DE)

( * ) Notice: Subject to any disclaimer, the term of this patent is extended or adjusted under 35 U.S.C. 154(b) by 743 days.

(21) Appl. No.: 11/890,535

(22) Filed: Aug. 6, 2007

(65) Prior Publication Data

US 2008/0028955 A1 Feb. 7, 2008

(30) Foreign Application Priority Data

Aug. 7, 2006 (DE) ..... 10 2006 037 109

(51) Int. Cl.
*B41F 17/00* (2006.01)
*B41F 17/24* (2006.01)
*B41M 1/40* (2006.01)

(52) U.S. Cl. ..... 101/44; 101/35; 101/41; 101/126

(58) Field of Classification Search ..... 101/35, 101/41, 44, 126, 485; 198/160.1, 419.1, 198/401

See application file for complete search history.

(56) References Cited

U.S. PATENT DOCUMENTS 3,783,777 A * 1/1974 Killen et al. ..... 101/40
5,207,153 A * 5/1993 Thomason ..... 101/35
5,377,816 A * 1/1995 Deligi et al. ..... 198/619
5,806,420 A 9/1998 Erhard ..... 101/37
6,000,329 A * 12/1999 Averill ..... 101/35
6,082,256 A 7/2000 Hellmeier et al. ..... 101/35
6,148,721 A * 11/2000 Hellmeier et al. ..... 101/35
6,543,346 B2 4/2003 Rodefeld ..... 101/35
6,578,475 B1 * 6/2003 Siedlaczek ..... 101/35
6,834,581 B2 * 12/2004 Ackley ..... 101/35
6,843,172 B2 * 1/2005 Polloni et al. ..... 101/35
6,857,358 B2 * 2/2005 Dittrich et al. ..... 101/35
7,171,896 B2 2/2007 Steffen ..... 101/126
2005/0223918 A1 10/2005 Steffen et al. ..... 101/123
2006/0288888 A1 * 12/2006 Wieland ..... 101/35

FOREIGN PATENT DOCUMENTS

DE 20220688 4/2004

* cited by examiner

*Primary Examiner*—Leslie J Evanisko
*Assistant Examiner*—Marissa L Ferguson-Samreth
(74) *Attorney, Agent, or Firm*—Andrew Wilford

(57) ABSTRACT

Objects to be printed are loaded one-by-one onto a conveyor extending through and upstream from a printing station in a longitudinally extending row in groups each having a predetermined number n of longitudinally aligned objects and a longitudinal length equal to n times a predetermined step length and with the groups separated in the row from one another by an empty gap having a short length equal to n−1 times the predetermined step length. The thus oriented objects are moved by the conveyor through the printing station in alternating long steps having a long length equal to n times the predetermined step length and short steps equal to n−1 times the predetermined step length such that with each long step one of the groups is positioned in the printing station. In the printing station the objects are taken off the conveyor, printed, and returned to the conveyor between the long steps.

16 Claims, 4 Drawing Sheets

SYSTEM FOR PRINTING PASSING OBJECTS

FIELD OF THE INVENTION

The present invention relates to a printing system. More particularly this invention concerns a system for printing on a row objects moving past on a conveyor.

BACKGROUND OF THE INVENTION

In the mass-production of consumer products it is often necessary to print product information and the like on the objects as they move along a conveyor. The printing has to be carried out quickly and without disrupting the continuous or step-wise advance of the objects along the conveyor path. The method for printing on objects that is current in industry uses silk-screen printing, tampon printing, offset printing, flexo-printing, ink-jet printing or similar processes. Thus, any objects such as, e.g. bottles, cans or even data carriers, especially digital-data disks such as CD's and DVD's are entirely or partially printed preferably with silk-screen processes since serigraphs have properties in part that can not be produced or produced only with difficulty with other printing processes such as, e.g. flexoprinting or offset printing.

A type of silk-screen printing that is frequently used when printing rather small objects is the flat silk-screen printing process. Flat silk-screen printing mechanisms use a screen that is flatly clamped in a frame and contains the information to be printed. Such printing mechanisms operate, based on principle, in such a manner that the surface of an object to be printed stands still relative to the printing screen during the printing. The printing process thus takes place in such a manner that printing ink is pressed through the printing screen with a silk-screen squeegee. The printing screen contains the printing image to be transferred here in such a manner that the printing screening is permeable for the printing ink only at the areas to be printed and therefore the printing ink can be transferred to the object to be printed only at these locations.

In addition to a printing machine, a lifting and lowering devices for the silk-screen printing frame or an object holder are required in addition to the cited silk-screen printing frame and a corresponding holder for it in order to be able to raise the object to be printed during the printing close enough to the screen frame, and on the other hand to ensure a sufficient amount of distance to the printing screen while the object is moved toward and away from the printing station.

Furthermore, moving elements for flood squeegees and printing squeegees are required that ink the printing screen with ink and transfer the printing image onto the object. All these elements must be more or less rapidly mechanically moved and in addition positioned with great accuracy so that limits are set to an increase in the speed of the mechanical operating sequences for greater productivity, and these limits can only be overcome with significant technological complexity. This applies in particular if objects are transferred in steps through a printing station during which an object is transported with each step and a printing must take place in the time between two steps. If the throughput of objects is to be increased in such an instance, this has an immediate negative influence on the time available for the printing.

In U.S. Pat. No. 7,171,896, for example, the printing screen and with it even part of the screen-printing mechanism are moved synchronously with the continuously moving object to be printed. As a result, the object does not have to be stopped for the printing but rather can be printed during a continuous and synchronized movement so that the time of the start-stop phases for stopping the object under the silk-screen printing mechanism and removing it again after the printing has taken place can be saved.

This has the disadvantage that the printing screen and the ink in it are exposed to high acceleration forces since, after a printing operation, the printing screen with the ink in it must be moved back as rapidly as possible into the starting position for the following job. Since the printing ink is thrown back and forth during the above, problems with a homogeneous distribution of ink on the printing screen and thus in the printed image can result, and there is furthermore the danger of ink being spilled out of the silk-screen printing frame, which can result in contamination of the machine or of the objects to be printed.

OBJECTS OF THE INVENTION

It is therefore an object of the present invention to provide an improved system for printing passing objects.

Another object is the provision of such an improved system for printing passing objects that overcomes the above-given disadvantages, in particular that allows a stationary printer to be used while still achieving a high throughput rate.

A further object is to provide a printing apparatus and method whereby the objects are oriented according to a predetermined pattern or sequence upstream and downstream of a stationary printing system so that standard upstream and downstream handling machines can be used.

SUMMARY OF THE INVENTION

These objects are attained in a system where the objects are loaded on a conveyor extending through and upstream from a printing station in a longitudinally extending row in groups each having a predetermined number n of longitudinally aligned objects and a longitudinal length equal to n times a predetermined step length and with the groups separated in the row from one another by an empty gap having a short length equal to n−1 times the predetermined step length. The thus oriented objects are moved by the conveyor through the printing station in alternating long steps having a long length equal to n times the predetermined step length and short steps equal to n−1 times the predetermined step length such that with each long step one of the groups is positioned in the printing station. In the printing station the objects are taken off the conveyor, printed, and returned to the conveyor between the long steps. Thus while the conveyor is moving the entire row of objects downstream in a short step, those objects that have been taken off the conveyor can be printed by a stationary printing mechanism and then set back down on the conveyor at the standstill of the conveyer after a short step. The freshly printed group is thus moved upstream by a distance equal to one long step.

In other words the objects are placed in/on a transport means of a conveyor in such a manner that a number n of positions occupied successively with objects is followed by a number n−1 of positions that are successively unoccupied and that n successive objects are transported into the printing station, removed from the transport means and printed while the transport means is transported further by n−1 positions, after which the n printed objects are placed back in/on the transport means and transported out of the printing station by a further shift of n positions, during which n new objects are transported at the same time into the printing station.

An essential concept of the invention is that in a printing procedure several, namely n objects are printed at the same time so that the work rate of the printer can be reduced.

However, if a printer no longer runs at the same cadence as the transport speed, the interval of the objects downstream of the printing station would change relative to the interval upstream of the printing station, given a uniformly continuous loading of the printing apparatus with objects, in as far as they are transported with the same transport speed in upstream and downstream of the printing apparatus. This problem is solved by printing several objects at a time and leaving between groups of objects a gap, so that transport can continue during printing, and the only affect is that the printing operation moves the objects one step upstream.

In order to circumvent this problem it is a further essential core concept of the invention that a transport means of a conveyor and/or of the transport path comprises a plurality of successive positions that are preferably equidistant from each other. Most of these positions are provided with an object to be printed, but there are positions that remain empty. Here the distribution of occupied positions to unoccupied positions is n to n−1 according to the invention, that is, e.g. 2 to 1, 3 to 2, 4 to 3, etc.

It can preferably be provided that the conveyor operates in such a stepped manner that two steps with the same duration are performed repeatedly in succession and that two whole-number multiples of a transport length are performed with a first step and one whole number multiple of a transport length is performed with a following second step of the same time duration. The transport length corresponds here to the equidistant interval of the previously cited positions. In a general embodiment the conveyor is stepped in such a manner that n whole-number multiples of a transport length are performed repeatedly in succession in a first step and subsequently n−1 steps of a transport length are performed.

If the stepping is carried out in this manner a stepped continuous operation of the apparatus of the invention results in which the objects can be continuously loaded in the selected step on/into the transport means in a stepped manner with an appropriate loading apparatus. The loading apparatus therefore operates at a constant rate, dropping one object onto the conveyor each time it steps, but since every other step is extra long, the necessary between-group gaps are formed in the row on the conveyor. The corresponding transport means, e.g. a conveyor belt, runs more rapidly in one of the two steps in this embodiment or accelerates more than in the other step in order to obtain the different transport lengths in the same time.

Another embodiment can provide that the conveyor operates in such a stepped manner that steps with a differing time are performed repeatedly in succession, that a transport by one step length takes place in each step and one or more free positions are produced on the transport means in that the time of the associated steps becomes $T_1$ equals $T_{0/2}$, $T_{0/3}$, etc. or $T_{0/N}$, in general, in which $T_0$ is the time of the slowest step. At the same time the loading of the objects takes place with step $T_0$ so that continuous loading of the objects onto the transport means is possible.

Another embodiment can provide that the conveyor operates in such a stepped manner that two steps with a differing time are performed repeatedly in succession, that n whole-number multiples of partial steps are performed with a first stop n and n−1 whole-number multiples of partial steps are performed with a following second stop n−1, and that the transport means is moved further per time unit by one interval between two positions with each partial step. In this manner a thoroughly continuous stepped operation results in which a transport means, e.g. a conveyor belt transports the same transport length at each partial step. However, in this instance the loading has to take place in an asynchronous manner, that is, the loading must take place at n partial steps and then n−1 partial steps with loading must be waited for. The same sequence cited above also results in this manner.

Thus, the first and the second variants have the advantage that the objects can be loaded on/into a transport means in a uniformly stepped manner; however, the transport means is accelerated differently in the case of two successive steps, whereas on the other hand in the third variant the transport means transports in a uniformly stepped manner and the objects are loaded on/into the transport means nonuniformly, namely in the cycle load n times, do not load n−1 times, and so on.

The invention has the advantage independently of the previously named variants that the use of a stepped drive for the transport of the objects along a transport path and the use of one or more printers with a low production rate along the transport path are possible and that in each instance several objects are printed at the same time during one or several steps.

It always remains certain that a product sequence existing when the objects enter the printing station is available again in the same manner as they exit the printing station by means of a controlling how the objects are transported in a ratio of n to n−1 multiples of a transport length (position interval) by a transport means to a printing apparatus and there, when n objects have arrived in the printing apparatus, these n objects are removed from the transport means and simultaneously printed while the transport means transports multiples of a transport length further and then the n printed objects are placed back onto the transport means and are transported further over a length of n single transport lengths.

A preferred embodiment provides in this connection that the sequence of the transport lengths is such that a single transport length is followed by a double transport length, thus, n=2 is selected.

The transport means can be designed as at least one conveyor belt, especially two conveyor belts running parallel transversely adjacent one another. This has the advantage that objects to be printed can be lifted off simultaneously from below from the conveyor belt with a lifter upward in the direction of a printing apparatus, especially to a printing element of the printing apparatus such as e.g. a printing screen, so that in a following step the conveyor belt is transported further without entraining the objects. Such a lifter can form part of a printer.

It can furthermore be provided that the lifter comprises a lift plate on which all objects rest when lifted up and that a groove extending along the conveyor belt is formed in the lift plate below whose upper face the conveyor belt runs when the plate is raised. Thus, each object rests on the lift plate after being raised and the conveyor belt moves without contact with an object held up in the printing station.

In this case the lift plate comprises at least one stop edge on its upper side, in particular one that extends transversely adjacent but parallel to the conveyor belt, against which the objects can be pushed to align the objects perfectly with the printer. Thus, the objects, in particular all at the same time, can be aligned/centered prior to a printing process in a lifter in order to achieve reproducible prints.

The centering/alignment can take place in such a manner that the pushing apparatus comprises at least one pushing element associated with each object which element can be shifted in the direction of an object and in particular in the direction of the stop edge, that is transversely of the transport direction. In such an embodiment two pushers are preferably associated with each object, which is advantageous in the case of disk-like round objects such as a CD or DVD since then a three-point system results between two push elements and one stop edge that brings about a perfect centering/alignment.

Printing processes that can be used in a printing apparatus can be in particular a silk-screen printing process, e.g. the flat silk-screen printing process, or an ink-jet printing process.

For example, the process in accordance with the invention is described in the following using silk-screen printing on CD's, which process in accordance with the invention can also be used without limitation in combination with other printing processes and printing mechanisms, e.g. tampon printing, ink-jet printing, thermoprinting, transfer printing, or also printing processes that operate in a rotating manner such as flexoprinting, offset printing, gravure printing, etc. as well as also with other objects.

During the manufacture of digital disks such as CD's, DVD's, etc. (designated in the following globally as CD's) the disks are manufactured in an injection-molding machine as polycarbonate disks and the data pits stamped into a surface during the injection-molding process are vapor-deposited in a following step with a reflecting layer, e.g. aluminum or gold.

A subsequently applied lacquer coating protects the sensitive information layer against mechanical influences and the CD's produced in this manner are set on transport spindles. The spindles filled in this manner with CD's are then shipped for printing into the input side of a printing apparatus. Since the CD's must be separated again for printing, they are removed from above from one or more spindles at the same time, e.g. by means of a vacuum suction system and deposited on a transport system or on individual transport carriers provided to this end.

The transport system can be, e.g. a conveyor belt with or without built-in entrainment means or centering devices or can also comprise transport carriers provided expressly for receiving CD's. The drive of the transport system can operate in a stepped manner or continuously as a function of the printing process used or can also be a combination of different motion operating sequences. It is as a rule required that the unprinted CD's, that have a reflective, shiny surface on the side to be printed after their manufacture, be provided at first with a homogenous, opaque, white printing that as a rule covers the entire surface and serves as background for a subsequent multicolor printing.

Since a relatively thick ink layer must be applied in order to achieve a sufficient degree of whiteness, a silk-screen printing process is usually used for this purpose. To this end the CD's removed from a separating station with one or more spindles are loaded on a conveyor that transports the CD's to a first silk-screen printing station. According to the invention a flat silk-screen printing mechanism is used and is designed in such a manner that at least two CD's can be printed at the same time. In order to continue to place CD's from the separating station onto the conveyor during the time the silk-screen printing mechanism is active the invention provides that the CD's that are located below the silk-screen printing device in a printing position during the printing are raised up by a so far from the conveyor that on the one hand printing can take place without problems by the silk-screen printing device and on the other hand a transport movement of the conveyor can take place without influencing the raised CD's in their position.

To this end the conveyor can be designed, e.g. as a circulating conveyor belt onto which the CD's are placed by the separating station or loading means. The drive of the conveyor belt takes place here in a stepped manner such that the conveyor belt is shifted further at each step alternating by one desired transport length or by a double transport length so that two CD's at a time come to successively rest in front of the inlet into the silk-screen printing mechanism followed by an empty position.

The CD's are loaded into the silk-screen printing device by means of a step with a double transport path so that both CD's come to rest at one printing position. In this position the CD's are raised by a lifter attached below the conveyor belts to such an extent that they on the one hand are lifted up off of the conveyor belt and in addition rest above any entrainment elements on the conveyor belt and on the other hand are close enough to the screen of the silk-screen printing device that the surface of the CD's can be printed by the silk-screen printing device.

To this end the lifter can have seats for the CD's to be printed and optional additional centering formations for the CD's in order to ensure a precise positioning for printing in this manner. Furthermore, additional holders for the CD's during the printing can be provided in the lifter such as, e.g. clamping devices or vacuum grippers in order to hold the CD's fast during the printing in the seats.

The printing of the CD's takes place during the time span of the next step, during which the conveyor belt is moved further by one single transport length. During this time the conveyor is moved further by only one position so that the following empty position on the conveyor belt stops under the first work position, viewed in the direction of transport, of the silk-screen printing device. In this position the printed CD's are again lowered after the printing has taken place onto the conveyor belt so that at time four CD's are resting in direct succession on the conveyor belt.

In the following step that is carried out with a double transport length the printed CD's are transported out of the silk-screen printing device and simultaneously the following unprinted two CD's are transported onto the printing positions of the silk-screen printing mechanism. It is possible with this operating sequence, to provide all CD's placed on the conveyor belt with silk-screen printing, during which the short work step of the silk-screen printing device corresponds to only one half the long printing step.

It is of course also possible without limiting the embodiment of the invention to select another combination, e.g. 3:2 instead of an operating sequence of single and double transport length. In this instance three CD's are printed at the same time in the silk-screen printing mechanism while the printing apparatus is moved further once by a double transport length or in the other embodiment twice by a single step.

In the general instance the transport of the CD's takes place in such a manner that a number n of CD's are placed onto the particular transport positions of the conveyor following each other directly and that they are followed by a number n−1 of empty transport positions. Then, in the following silk-screen printing unit n CD's are simultaneously printed during the time of n−1 steps.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
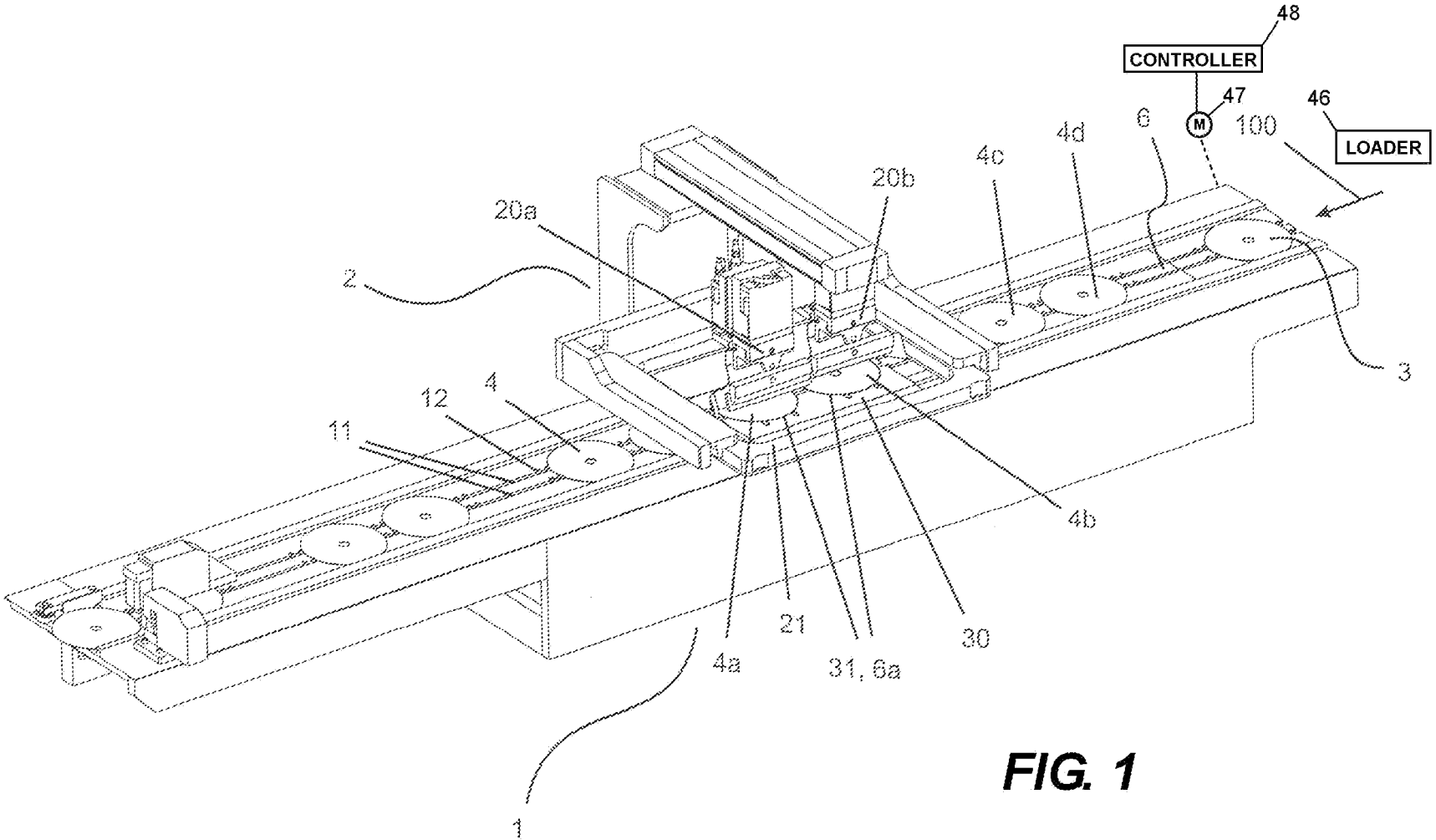
FIG. 1 is a partly schematic perspective view of the printing system according to the invention.

As seen in FIG. 1 CD's 4 are placed by a loading apparatus 46 at input station 3 onto a conveyor 1 comprising conveyor belts 11 with additional entrainment formations 12, so that the CD's 4 rest on the belts 11 and are transported via them in a transport direction 100, with the entrainment formations 12 simultaneously ensuring a uniform longitudinally spacing of the CD's on the conveyor belts 11.

The conveyor 1 shifts the CD's 4 on the conveyor belts alternating by one or two steps so that the CD's are grouped on the conveyor belts results 11 as shown in FIG. 1, with two CD's 4*c* and 4*d* directly following each followed by an empty position 6.

A silk-screen printer 2 is positioned along the longitudinal conveyor path and is constructed so that it can simultaneously print two CD's 4*a* and 4*b* that directly follow one another and that occupy positions 6*a*. After printing as described below they are then shifted with the following step through a double transport length downstream out of the printer 2. The conveyor 1 is driven by means of a transmission (not shown) and motor 47 and a corresponding electrical controller 48.

As soon as CD's 4*a* and 4*b* are at their position 6*a* they are lifted by a plate 30 of a lifter 5 to such an extent that they on the one hand no longer rest on the conveyor belts 11 but rather come to rest on seats 31 provided for this purpose on lift plate 30, and on the other hand conveyor belts 11 can move past under the CD's in guide grooves 44. Moreover, the CD's are lifted to such an extent that printing with the silk-screen printer heads 20*a* and 20*b* arranged above them can take place without problems. In this raised position the CD's can be aligned by a device 7 and optionally fixed in their positions at the same time so that they can be printed without problems.

Printing takes place during the following step with a single transport length, as a result of which the following CD's 4*c* and 4*d* are moved further by a single position and now come to rest directly upstream of work positions 6*a* of silk-screen printer 2. The printing takes place in a known manner in that printing ink is applied through a printing screen 21 provided with information by means of the printer heads 20*a* and 20*b* onto the upper faces of the CD's to be printed.

After printing has taken place the arresting of the CD's that optionally took place is released and the lift plate 30 with the printed CD's in lowered again by the lifter 5 during the standstill time of conveyor belts 11 so that the CD's again come to rest on conveyor belts 11. The following step with a double transport length now moves the printed CD's 4*a* and 4*b* out of the silk-screen printer and at the same time the next two directly following CD's 4*c* and 4*d* are transported into the silk-screen printing mechanism to work positions 6*a*.

Figure 2:
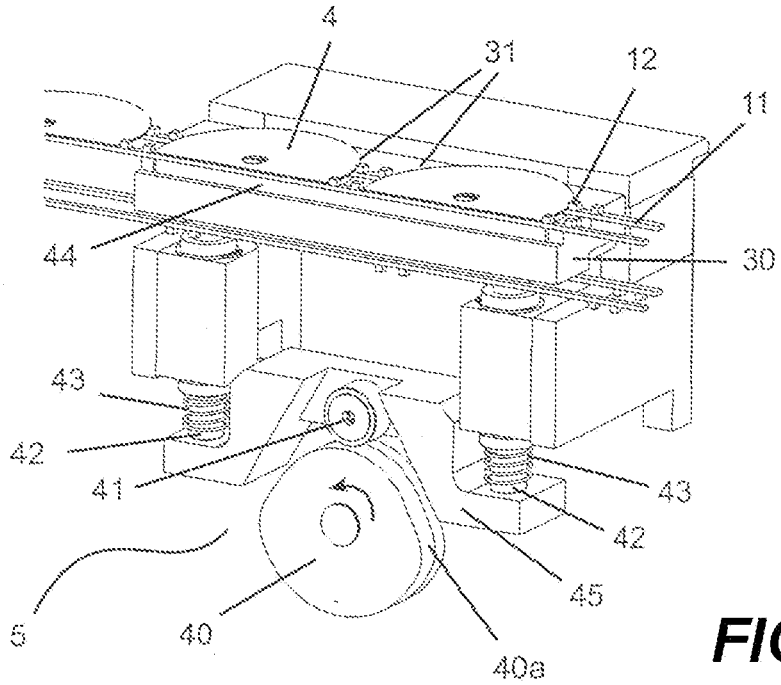
FIGS. 2-4 are various perspective views of the lifter of the printing system.

FIG. 2 shows the lifter 5 in the silk-screen printer 2 in the lower position. In this position lift plate 30 with the seats 31 located on its surface is in a lower position, as a result of which CD's 4 rest on the conveyor belts 11 and can be transported out of the silk-screen printer with a following step of the conveyor. To this end the lift plate 30 is connected via shafts 42 to a connecting bridge 45 that carries a movable roller 41 that rides on an outer surface 40*a* of eccentric roller 40 driven in a synchronized manner so that bearing plate 30 can be raised or lowered depending on the position of the eccentric roller 40. Pretensioning springs 43 press the roller 41 against the surface 40*a*. Alternatively, the eccentric roller can also be designed as a cam disk with a guide groove in order to effect forced guidance in this manner. Furthermore, the bearing plate is formed with the grooves or recesses 44 in which the transport belts 11 can be guided when the lift plate 30 is in its raised position.

Figure 3:
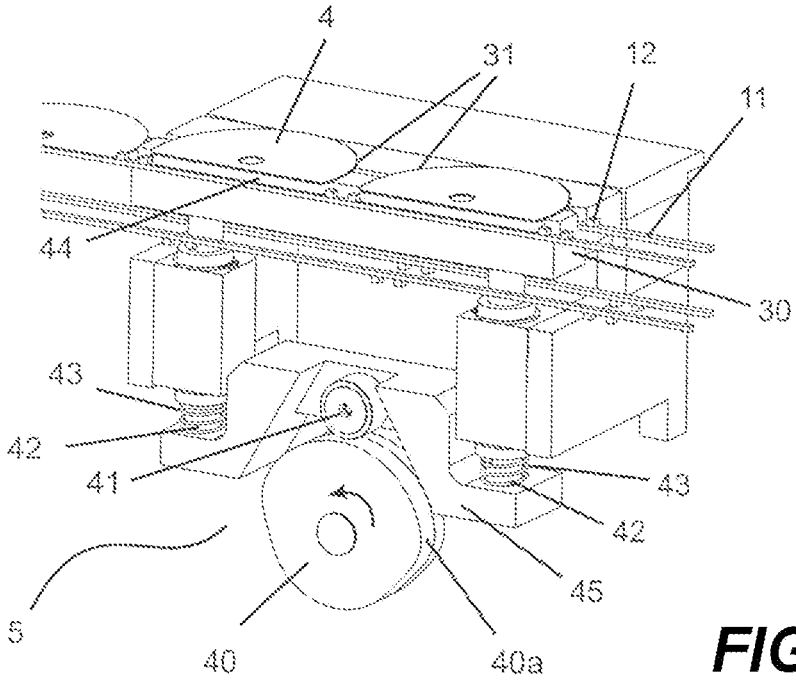

FIG. 3 shows lifter 5 in its raised position. In this position lift plate 30 is in an upper position as a result of which CD's 4 rest on seats 31 provided to this end and can be optionally fixed there by devices (not shown), e.g. by vacuum devices or mechanical clamps. Grooves 44 worked into lift plate 30 are advantageously designed in such a manner that transport belts 11 with the engagement means fastened on it can be guided past and below the CD's raised up in this position.

Figure 4:
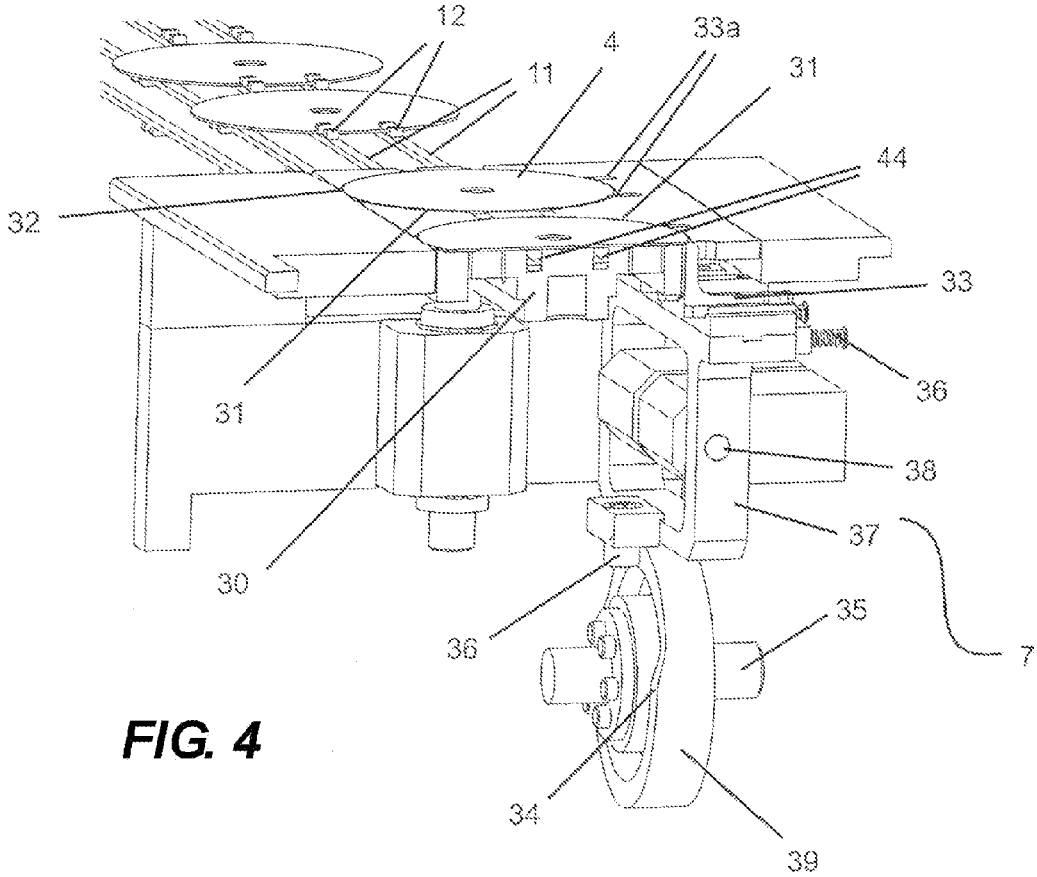

In order to realize an accurately filling printing it is furthermore provided, as shown by way of example in FIG. 4, that an alignment device 7 is integrated into lift plate 30, which alignment device is formed by a fixed stop edge 32 and a movable stop bar 33. To this end CD's 4, that have been lifted up from conveyor belts 11 by the lifter 5 and at first lie unaligned on seats 31, are pressed on their edge via tips 33*a* of stops 33 against a fixed stop 32 and held fast in this position or additionally fixed, e.g. by a vacuum.

It is advantageous if the upper edges of the stops 32 and 33*a* do not extend above the upper surface of the CD's so that printing screen 21 of silk-screen printer 2 cannot be damaged during printing. To this end the stops 33 are fastened on a carrier 37 that is supported so that it can pivot about a shaft 38 and on the side of the stops 33 a roller 36 is fastened that runs over a cam edge 34 of a wheel 39 supported on a drive shaft 35. The cam edge 34 is formed in such a manner that the stops 33 are moved to the CD edge by pivoting on the shaft 38 as a function of the position of rotation of rotary body 39 and therefore press the CD's against the fixed stop 32 or are moved away from it, thus freeing the CD's. The drive of rotary body 39 via the drive shaft takes place here synchronized with the lifting movement of lifter 5.

Figure 5:
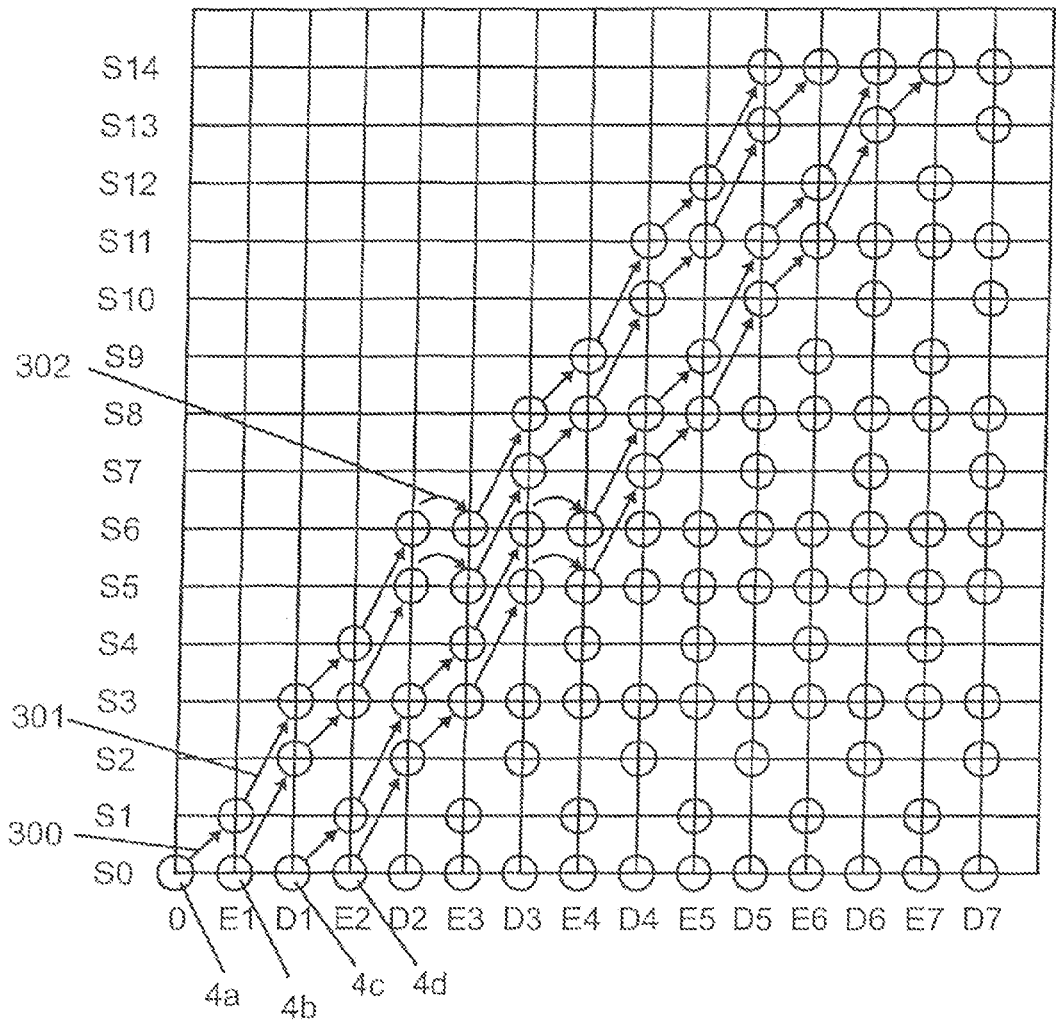
FIG. 5 is a chart illustrating operation of the system.

FIG. 5 schematically shows the operating sequence of the particular CD positions after the particular steps with a single or double transport length. Beginning at loading position 3, designated in the diagram with coordinates SO; 0, at which a first CD 4*a* is placed on the conveyor belt, this CD 4*a* is transported in a first individual step E1 by a single transport length to position 1, which is schematically represented with individual step arrow 300.

Another CD 4*b* is placed on in the same step so that now two CD's come to rest immediately one behind the other on the conveyor belt. The following step with double transport length D1 transports these two CD's 4*a* and 4*b* by a double step further, which is schematically represented with double step arrow 301, so that an empty position to CD 4*c* placed on in the same step results. In this manner CD's 4*a* and 4*b* pass through following individual and double transport lengths E2, D2 to step positions S5 and S6 at which the loading positions 6*a* of silk-screen printer 2 are located.

There, CD's 4*a* and 4*b* are lifted off as already described from the conveyor belt and printed by silk-screen printing during the next step E3 with a single transport length, which is schematically represented with double step arrow 302. During this time CD's 4*a* and 4*b* are not transported further so that after printing, the four CD's 4*a*, 4*b*, 4*c*, 4*d* come to rest directly on the conveyor belts 11 since the two following CD's 4*c* and 4*d* had been transported directly upstream of the printing station during the completed step with a single transport length.

In the following step with double transport length D3 the two printed CD's 4*a* and 4*b* are transported out of the printing station and the two following CD's 4*c* and 4*d* are transported into the printing station so that CD's 4*c* and 4*d* can be printed in step E4 that now follows with a single transport length.

Certain step positions such as, e.g. positions S8 or S11 or S14 result on account of the operating sequence of the CD transport taking place in this manner, as can be readily seen in FIG. 5, at which step positions a CD comes to rest for each individual step or double step. It is therefore useful to provide additional devices at one or several of these positions such as, e.g. a drying device for the imprinted printing ink since an optimal utilization of the drying performance of the ink dryer can be achieved here.

It is furthermore useful to provide the last position of conveyor 1, at which the printed CD's are removed from conveyor 1, at one of the named positions S8 or S11 or 514 since in this manner a continuous flow of material, e.g. for a following further printing or processing of the CD's is ensured.

We claim:

1. A method of printing on objects, the method comprising the steps of:

orienting the objects on a conveyor extending through and upstream from a printing station in a longitudinally extending row in groups each having a predetermined number n of longitudinally aligned objects and a longitudinal length equal to n times a predetermined step length and with the groups separated in the row from one another by an empty gap having a short length equal to n−1 times the predetermined step length;

displacing the oriented objects with the conveyor through the printing station in alternating long steps having a long length equal to n times the predetermined step length and short steps equal to n−1 times the predetermined step length such that with each long step one of the groups is positioned in the printing station; and in the printing station taking the objects off the conveyor, printing the objects, and returning them to the conveyor during the standstill after the succeeding short step.

2. The printing method defined in claim 1, further comprising the step of:

arresting the objects in the printing station between the long steps.

3. The printing method defined in claim 2 wherein the objects are arrested by being lifted during the short step off the conveyor.

4. The printing method defined in claim 1 wherein the objects are displaced through the long steps in a plurality of n steps equal of a predetermined step length and of a duration T1 and the conveyor is displaced in a succession of n−1 of a predetermined step length of a duration T0, whereby T1 is equal to T0 divided by N.

5. The printing method defined in claim 1 wherein n is 2.

6. The printing method defined in claim 1 wherein the conveyor is a pair of longitudinally extending and transversely spaced belts, the objects being engaged between the spaced belts and lifted thereof for printing wherein the spaced belts can be displaced without transporting the lifted objects.

7. The printing method defined in claim 1, further comprising the step of aligning the objects with respect to a printer in the printing station between the long steps.

8. The printing method defined in claim 1 wherein the objects are printed in a silk-screen process.

9. The printing method defined in claim 1 wherein the objects are printed in an ink-jet process.

10. The printing method defined in claim 1 wherein the long steps each have a time duration substantially equal to that of the short steps.

11. An apparatus for printing on objects, the apparatus comprising:

a printing station a conveyor extending through and upstream from the printing station;

loading means for orienting the objects on the conveyor in a longitudinally extending row in groups each having a predetermined number n of longitudinally aligned objects and a long longitudinal length equal to n times a predetermined step length and with the groups separated in the longitudinally extending row from one another by an empty gap having a short longitudinal length equal to n−1 times the predetermined step length;

drive means connected to the conveyor for displacing the oriented objects with the conveyor through the printing station in alternating long steps having a length equal to n times the predetermined step length and short steps equal to n−1 times the predetermined step length such that with each long step one of the groups is positioned in the printing station;

lifter means in the printing station taking the objects off the conveyor and returning them to the conveyor between the long steps; and printer means in the printing station for printing the objects while they are off the conveyor during the standstill after the succeeding short stop between the long steps.

12. The printing apparatus defined in claim 11 wherein the conveyor extends underneath and supports the objects along a path.

13. The printing apparatus defined in claim 11 wherein the conveyor includes a pair of longitudinally extending and transversely spaced belts, the lifter means including a lifter element engageable vertically between the spaced belts with the objects in the printing station, the printer means being above the conveyor.

14. The printing apparatus defined in claim 13, further comprising aligning means for transversely shifting the objects and aligning them when raised off the belts with the printer means.

15. The printing apparatus defined in claim 14 wherein the aligning means includes a stop edge positioned transversely to one side of a path in the printing station and a pusher engageable on the other side of the path in the printing station with the objects to shift them against the stop edge.

16. The printing apparatus defined in claim 11 wherein the conveyor is provided with a succession of entrainment elements spaced apart by a distance equal to the short length.

* * * * *